United States Patent [19]

Riddell

[11] Patent Number: 5,038,701

[45] Date of Patent: Aug. 13, 1991

[54] METHOD AND MEANS FOR COVERING OPENINGS IN HULLS OF DAMAGED SHIPS

[76] Inventor: Floyd A. Riddell, 5115 Eagle Trail, Houston, Tex. 77084-2927

[21] Appl. No.: 498,012

[22] Filed: Mar. 23, 1990

[51] Int. Cl.[5] ..... B63B 43/16

[52] U.S. Cl. ..... 114/229; 114/227

[58] Field of Search ..... 114/227-229, 114/222; 220/230, 232; 405/12

[56] References Cited

U.S. PATENT DOCUMENTS

| | | | |
|---|---|---|---|
| 635,939 | 10/1899 | Mason | 114/229 X |
| 689,979 | 12/1901 | Mason | 114/227 X |
| 770,078 | 9/1904 | Kruger | 114/229 |
| 932,720 | 8/1909 | Reinhardt | 114/229 |
| 1,122,047 | 12/1914 | Villiers | 114/229 |

*Primary Examiner*—Ed Swinehart

*Attorney, Agent, or Firm*—Dodge Bush Moseley & Riddle

[57] ABSTRACT

A method and means for covering an opening (14) in the damaged metal hull (12) of a ship (10) including a flexible covering material (16) having a plurality of electromagnets (36) embedded therein between inner and outer layers (30, 34) and arranged in generally transverse rows. Electrical energy is applied in sequence to the electromagnets (36) after unrolling of the flexible material (16) alongside the hull (12) from the uppermost row of electromagnets (36) to the lowermost row of electromagnets (36). Air assist members (48) are provided to force the flexible material (16) toward the hull (12).

11 Claims, 2 Drawing Sheets

METHOD AND MEANS FOR COVERING OPENINGS IN HULLS OF DAMAGED SHIPS

BACKGROUND OF THE INVENTION

This invention relates to a method and means for covering openings in the hulls of damaged ships and more particularly, to such a method and means for the exterior covering of an opening in the hull of a ship resulting from accidents to block or restrict flow of liquid lading, such as oil, from the ship.

Heretofore, various methods and means have been provided to cover an opening in the damaged hull of a ship resulting from a collision or the like.

Such prior art methods and means have included a flexible covering utilized with magnets to hold the covering onto the metal hull of a ship over an opening. For example, U.S. Pat. No. 770,078 dated Sept. 13, 1904, shows a magnetic curtain for covering leaks in ships with the curtain being unrolled alongside the ship over a hole provided in the hull. Magnets secured to the flexible curtain assist the water pressure in holding the curtain against the hull.

U.S. Pat. No. 932,720 dated Aug. 31, 1909, shows means for closing holes in a steel hull in which a series of magnets may be energized for securing an inflatable bag or blanket to the hull. The blanket is made of a strong material impervious to water or air, such as canvas and rubber combined. U.S. Pat. No. 3,669,005 dated June 13, 1972, shown an apparatus and method for sealing a vessel opening in which anchoring devices for a cover over an opening in a hull are provided adjacent lower corners of the cover and are secured to the hull by electromagnets. The cover is formed of an elastomeric material such as rubber and the outer layer has an armored covering to protect the cover from sharp jagged edges about the opening in the hull.

Such prior art means such as the above, do not utilize electromagnets which may be precisely controlled individually or sequentially in predetermined groups for sequentially mounting flexible covering means over an opening in the hull from the uppermost position of the covering means to the lowermost position thereof.

SUMMARY OF THE INVENTION

This invention is directed to a method and means for covering an opening in the damaged hull of a ship from the outside of the hull to block leakage of liquid lading, such as oil from the ship. A roll of liquid impermeable flexible material containing a plurality of spaced electromagnets arranged in transversely extending rows is unrolled alongside the outer surface of the steel hull. The rows of electromagnets are electrically energized in sequence from the uppermost row to the lowermost row after the unrolling of the flexible material thereby to secure the flexible liquid impermeable material to the metal hull of the ship. Each electromagnet is preferably of a cylindrical shape adapted to be individually controlled, if desired, and the electromagnets are preferably positioned in a plurality of closely spaced horizontal rows. The horizontal rows of electromagnets may be energized in sequence from the uppermost row to the lowermost row after the flexible covering material is unrolled along the side of the metal hull. The cylindrical electromagnets are easily embedded or positioned between inner and outer layers of the flexible material or cover and may be suitably sealed therebetween with a bonding material.

In addition, air assist elements or members are provided adjacent each of the cylindrical electromagnets to force or urge the flexible material and associated electromagnets toward the steel hull for contact therewith upon a supply of air provided to the air assist elements. Air supply lines to the air assist elements may be secured to the flexible cover by a suitable flexible plastic material.

It is an object of this invention to provide a method and means for covering an opening in a hull of a damaged ship to block or restrict the flow of liquid lading therefrom.

It is a further object of this invention to provide such a method and means in which the covering material includes a plurality of electromagnets arranged generally in horizontal rows with the electromagnets being energized in sequence from the uppermost rows to the lowermost rows.

An additional object of this invention is to provide separate means to assist in forcing the flexible covering material toward the metal hull to a position where the electromagnets will be magnetically attached for securing the flexible material thereto.

Other objects, features, and advantages of this invention will become more apparent after referring to the following specification and drawings.

DESCRIPTION OF THE INVENTION

Figure 2:
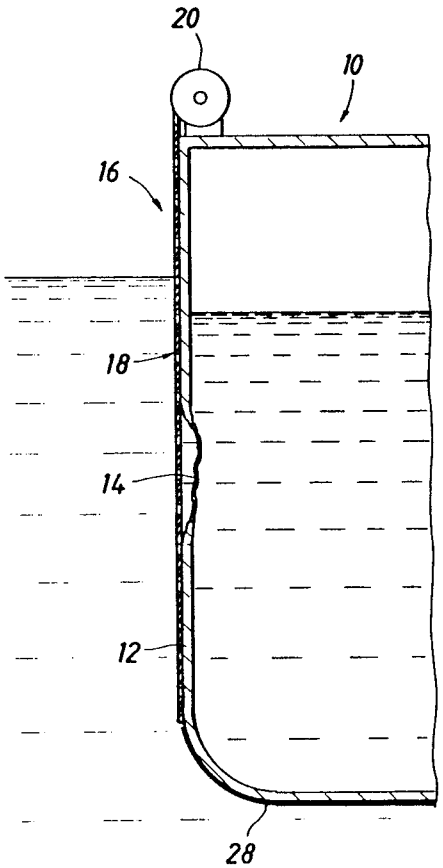
FIG. 2 is a section taken generally along line 2—2 and showing the covering material in position along the hull.

Referring to the drawings, a ship is indicated partially at 10 having a metal hull 12 in which a hole or opening shown at 14 has been ripped resulting from a collision or the like. Flexible covering means comprising this invention and generally indicated at 16 is shown secured to the outer surface of metal hull 12 and covering the jagged hole 14 to restrict or stop the flow of a liquid lading therefrom, such as oil or the like.

Flexible covering means 16 includes a flexible material generally indicated at 18 and being impermeable to fluids. Flexible material 18 is wound onto a roll or reel 20 having end supports 22 for lowering alongside the outer surface of metal hull 12. A motor shown at M may be provided for reeling or unreeling roll 20.

Figure 1:
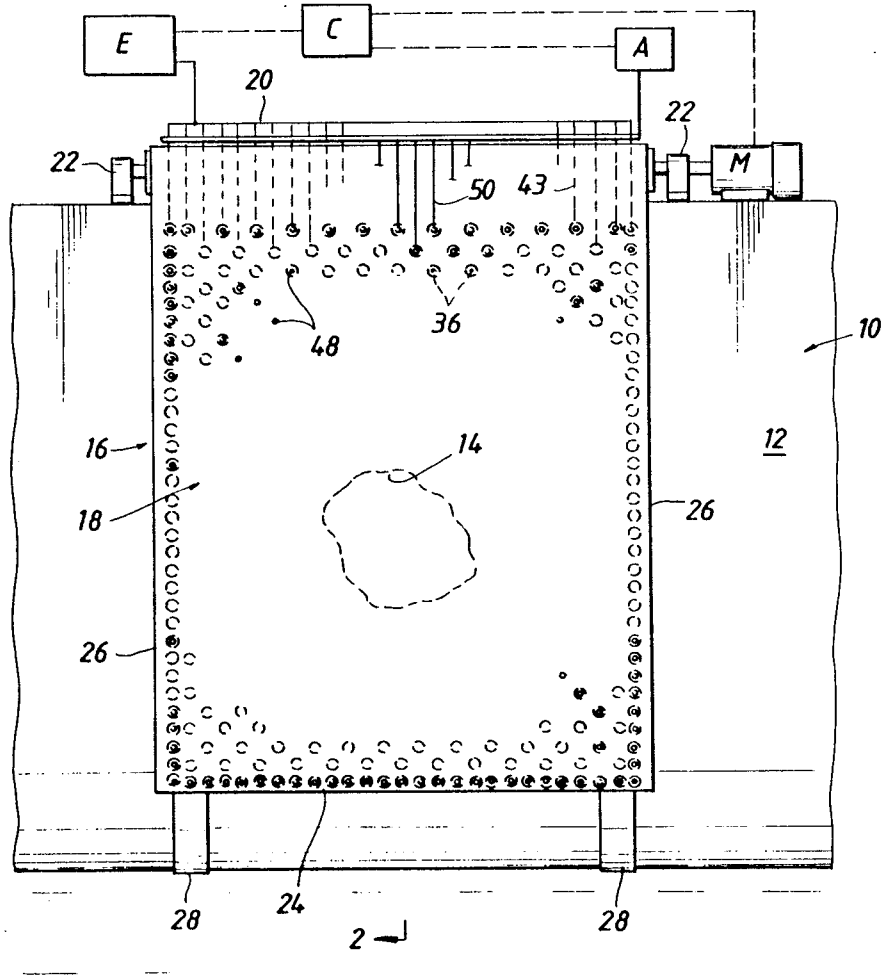
FIG. 1 is a side elevation of a portion of the hull of a ship showing the rectangular covering material comprising the present invention unrolled alongside the outer surface of the hull and covering the hole or opening ripped in the side of the hull.

FIG. 1 shows flexible material 18 of a generally rectangular shape magnetically secured to hull 12 and having a lower end 24, parallel sides 26, and an upper end on roll 20. Suitable straps 28 may be attached to end 24 for securement about hull 12 as may be desired under certain conditions. Means (not shown) may be provided to release and propel straps 28 beneath hull 12 to the opposite side thereof upon securement of flexible material 18 on hull 12 with straps 28 being pulled taut from the opposite side of the hull to additionally secure flexible material 18 on hull 12, such as might be required in the event of a malfunction of power sources, for example.

Figure 3:
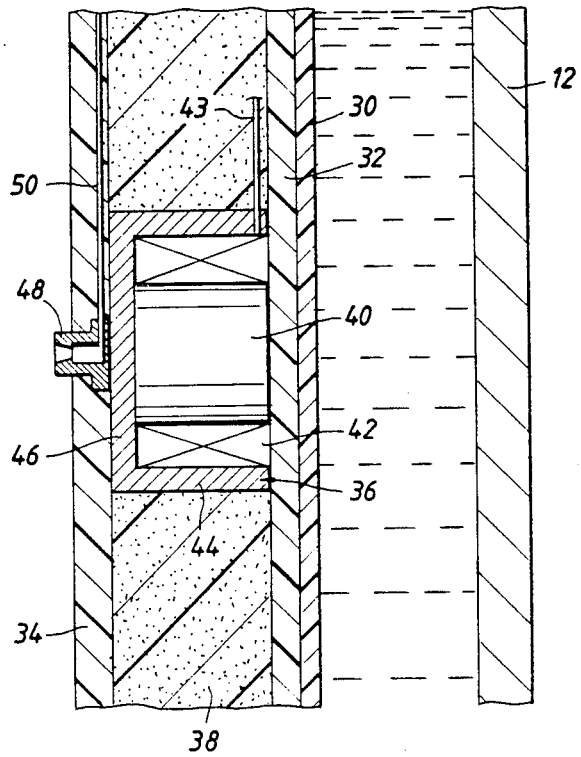
FIG. 3 is an enlarged cross section of a portion of the covering material showing an electromagnet and associated air assist means thereon for directing or forcing the flexible covering material toward the hull.
Figure 4:
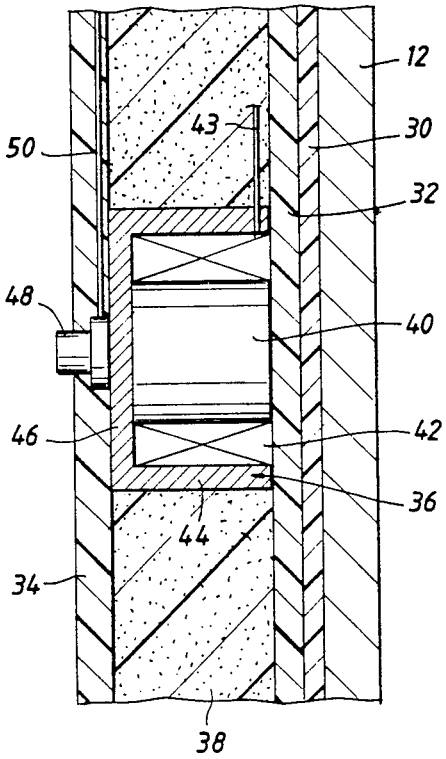
FIG. 4 is a section similar to FIG. 3 but showing the electromagnet in engagement with the metal hull of the ship.
Figure 5:
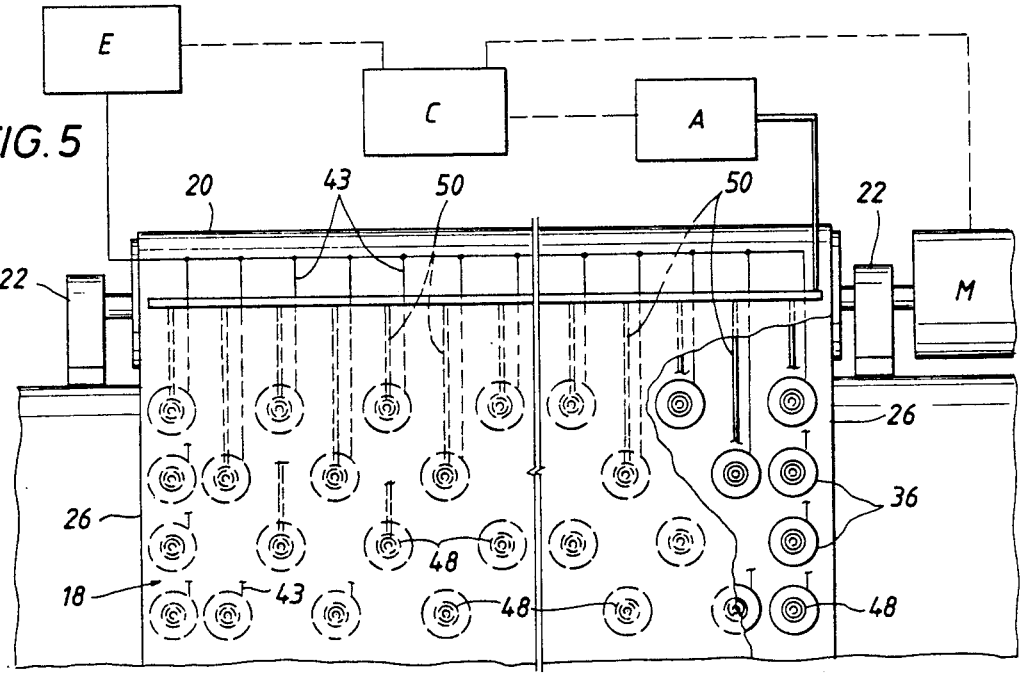
FIG. 5 is an enlarged fragment of FIG. 1 showing generally schematically the controls and power sources for the operation of the covering means of the present invention.

Referring now to FIGS. 3 and 4 in which flexible material 18 is specifically illustrated, an inner layer 30 is provided from a tough elastomeric material, such as sold under the trade name "Hyperlastic" by Gundle Lining Systems, Inc., 19103 Gundle Road, Houston, Texas, and having a thickness of around 0.030 inch. A protective intermediate layer 32 is provided adjacent inner layer 30 and may be formed of a suitable "Kevlar" (a registered trademark of DuPont) material such as sold under the designation "VKWF162" by Advanced Textiles, Inc., Seguin, Texas, and having a thickness of around 0.020 inch. An outer tough protective layer 32 is provided likewise formed of a suitable "Kevlar" material with a flexible type sealer material combined with the "Kevlar" outer layer 34.

Embedded or sandwiched between intermediate layer 32 and outer layer 34 are a plurality of spaced electromagnets each generally indicated at 36 and arranged in a plurality of generally transverse rows extending from the upper end of flexible material 18 to the lower end 24 thereof across the entire width of flexible material 18 between parallel sides 26. Electromagnets 36 are preferably cylindrical in shape and may, for example, be of a size having a diameter of 3½ inches and a height of 1½ inches and spaced around 4 to 6 inches from each other in the transverse rows. Electromagnets 36 and adjacent rows are staggered. A flexible filler material of a suitable plastic material is positioned about electromagnets 36 between intermediate layer 32 and outer layer 34. Thus, flexible material 18 has a total thickness of around 1¾ inches.

Each electromagnet 36 has a central iron core 40, a winding 42 surrounding iron core 40, a cylindrical plastic outer case 44 about winding 42, and a plastic cover 46. An electrical wire or conduit 43 is provided for each electromagnet 36. As an example of a suitable electromagnet 36, an electromagnet designated as "EMR35" is sold by Master Magnetics, Inc., Castle Rock, Colorado, having a diameter of 3½ inches, a height of 1½ inches, and operating at 8 watts to exert a magnetic pull of 650 pounds. It may be desirable to provide additional wattage in order to increase the magnetic pull for certain operating conditions. The number of electromagnets 36 is increased along sides 26 and end 24 in order to provide additional securing strength along the lower end and sides of flexible material 18.

While electromagnets 36 may be adequate to provide sufficient magnetic attraction to metal hull 12 under most operating conditions, it may be necessary to provide additional means to assist in directing or forcing flexible material 18 toward steel hull 12 for securement by electromagnets 36. For this purpose, an air assist member is shown at 48 for each electromagnet 36 positioned centrally on the outer cover 46 of electromagnet 36. An air conduit or line 50 extends to air assist member 48 and upon the supply of air to air assist member 48, an air jet is directed outwardly of electromagnet 36 with the opposite end forcing or pushing electromagnet 36 in a direction toward hull 12. A suitable source of air is shown at A and air conduits or lines 50 are embedded in flexible material 18. Likewise, electrical conduits 43 to electromagnets 36 are embedded in flexible material 18 with the electrical current being supplied by a suitable source of electrical energy shown at E.

A control panel is shown at C to control of motor M to wind and unwind flexible material 18, to control the energizing and de-energizing of electromagnets 36, and to control the supply of air to air jet assists 48. It is noted that a separate electrical line 43 is provided for each electromagnet 36 with each electromagnet having a designated number and position on flexible material 18 for monitoring. Selective rows of electromagnets 36 may be energized or de-energized as desired.

In operation, roll 20 is unrolled upon energizing motor M alongside the outer surface of hull 12 to length sufficient to adequately cover hole 14. Then, horizontal rows of electromagnets 36 are energized in sequence beginning with the uppermost row of electromagnets 36 and continuing to the lowermost row of electromagnets 36 adjacent lower end 24. If needed, air assist member 48 may be utilized to force flexible material 18 closely adjacent hull 12 so that adequate magnetic attraction is provided upon energizing of electromagnets 36 to secure properly flexible material 18 against steel hull 12. Straps 28 may be propelled beneath hull 12 to the opposite side thereof by suitable means (not shown) for securement to the opposite side of hull 12.

It is to be understood that the present invention may be provided in a portable packaging arrangement for transport to a ship where needed. Also, a ship might be fitted with suitable sources of electrical energy and air at a predetermined location to adapt itself for the use of such a flexible covering means.

While preferred embodiments of the present invention have been illustrated in detail, it is apparent that modifications or adaptations of the preferred embodiments will occur to those skilled in the art. However, it is to be expressly understood that such modifications and adaptations are within the spirit and scope of the present invention as set forth in the following claims.

What is claimed is:

1. In a ship particularly adapted for the transport of liquid lading and having a metal hull;

improved means for covering an opening in the metal hull resulting from accidents to block the flow of liquid lading from the hull, said improved means comprising:

a flexible covering material adapted to be positioned alongside the outer surface of the metal hull over the opening in the hull, said covering material being formed of a liquid impermeable material and having a plurality of electromagnets arranged in generally transverse rows from the upper end of said covering material to the lower end thereof upon the positioning of the material along the hull of the ship; and means to supply electrical current to said electromagnets in sequence to said transverse rows between the upper end of said covering material and the lower end of said covering for securing said magnets electrically to said hull in sequence.

2. In a ship as set forth in claim 1;

said improved means comprising a coiled roll of said flexible covering material, and means to unroll said covering material along the outer surface of the hull for covering said opening.

3. In a ship as set forth in claim 2;

said covering material including means to urge said electromagnets toward the hull of said ship for magnetically securing said electromagnets.

4. In a ship as set forth in claim 3;

said means to urge said electromagnets toward the hull comprising air assist devices attached to said flexible material to urge said material toward said hull.

5. Covering means for positioning over an opening in the metal hull of a ship resulting from an accident to block the flow of liquid lading from the hull; said covering means comprising:

a flexible liquid impermeable sheet material having a plurality of spaced electromagnets embedded therein for magnetic securement to said metal hull, said electromagnets being embedded in a plurality of generally transversely extending rows for being electrically energized in sequence from the uppermost row to the lowermost row; and means to supply electrical energy to said electromagnets in sequence to said transverse rows from the upper end of said flexible material to the lower end thereof, upon the positioning of said material along the hull of the ship.

6. Covering means for a ship hull as set forth in claim 5;

said covering material including means to urge said electromagnets toward the hull of said ship for magnetic securement of said electromagnets to said hull.

7. Covering means for a ship hull as set forth in claim 5;

said liquid impermeable flexible material including an inner elastomeric layer contacting the hull, a flexible intermediate high strength plastic layer adjacent said inner layer, and a flexible high strength outer layer;

said electromagnets being of a cylindrical shape and embedded between said inner and outer layers.

8. Covering means for a ship hull as set forth in claim 5;

electric circuit means in said flexible material extending to each of said electromagnets for conducting electrical energy to said electromagnets.

9. Covering means for a ship hull as set forth in claim 8;

control means for said electrical energy to supply a predetermined current to predetermined electromagnets in sequence generally from the uppermost magnets to the lowermost magnets thereby to permit the securement of the flexible material against the metal hull of the ship in sequence from the upper end of the covering means to the lower end thereof after the flexible material is unrolled alongside the hull.

10. A method of mounting a covering material over an opening in a damaged metal hull of a ship to block or restrict the flow of liquid lading from the hull; said method comprising the following steps:

forming a flexible covering material including an inner layer and an outer layer with a plurality of spaced electromagnets embedded between the inner and outer layers in transverse rows and electrical circuitry extending to each of the electromagnets;

applying the flexible covering material against the hull of the ship over the opening therein with the electromagnets arranged generally in transverse rows from the upper end of the covering material to the lower end of the covering material;

providing a plurality of spaced air assist members on said flexible covering material;

providing a supply of air to selected air assist members upon positioning of the flexible covering material alongside the hull of the ship for forcing the flexible covering material toward the metal hull for magnetic securement of said electromagnets; and providing electrical energy to said electromagnets in sequence from the upper end of the covering material to the lower end of the covering material thereby to secure magnetically in sequence said covering material to said hull over said opening.

11. A method as set forth in claim 10 including the steps of providing air conduits in said flexible material to said air assist members; and embedding said air conduits within said flexible material for securing said air conduits thereto.

* * * * *